United States Patent [19]

Wolff

[11] 4,409,099

[45] Oct. 11, 1983

[54] SIEVE DECK FOR SIFTING MACHINES

[75] Inventor: Kurt Wolff, Bundesrepublik, Fed. Rep. of Germany

[73] Assignee: Steinhaus GmbH, Fed. Rep. of Germany

[21] Appl. No.: 243,964

[22] PCT Filed: Jul. 2, 1980

[86] PCT No.: PCT/DE80/00095

§ 371 Date: Mar. 2, 1981

§ 102(e) Date: Mar. 2, 1981

[87] PCT Pub. No.: WO81/00065

PCT Pub. Date: Jan. 22, 1981

[30] Foreign Application Priority Data

Jul. 4, 1979 [DE] Fed. Rep. of Germany ..... 2926987

[51] Int. Cl.[3] ..... B07B 1/49

[52] U.S. Cl. ..... 209/399; 209/405

[58] Field of Search ..... 209/397–399, 209/392, 405, 408; 210/498

[56] References Cited

U.S. PATENT DOCUMENTS

| | | | |
|---|---|---|---|
| 2,883,051 | 4/1959 | Maeder | 209/399 X |
| 3,905,897 | 9/1975 | Jacobson | 209/405 |
| 4,062,769 | 12/1977 | Simonson | 209/399 |
| 4,141,821 | 2/1979 | Wolff | 209/405 |

FOREIGN PATENT DOCUMENTS

| | | | |
|---|---|---|---|
| 2749530 | 6/1978 | Fed. Rep. of Germany | 209/399 |
| 2849838 | 9/1979 | Fed. Rep. of Germany | 209/399 |
| 1483217 | 8/1977 | United Kingdom | 209/397 |

*Primary Examiner*—Ralph J. Hill

*Attorney, Agent, or Firm*—Pollock, Vande Sande & Priddy

[57] ABSTRACT

Sifters which may comprise a plurality of elastic plates with embedded reinforcements are arranged to be releasably attached at the corners to spacer elements supported on a main frame. Adjoining corners of adjacent sieve plates are supported on a single spacer element. Each corner has a depending stub which is received in an opening in the spacer element. Each sieve element may have a peripheral sealing lip. The cross section of the frame struts is shaped to allow sifted material to fall off.

5 Claims, 10 Drawing Figures

SIEVE DECK FOR SIFTING MACHINES

TECHNICAL FIELD

The invention relates to a sieve deck for sifting machines, sifting boxes or the like.

A sieve deck of this kind comprises a support structure and sieve elements releasably disposed thereupon and provided with a multiplicity of sieve openings. These sieve elements extend to form a continuous separation face and have the basic shape of a polygon, the sieve elements being secured on the support structure at least in the vicinity of some of their corners.

PRIOR ART

A known sieve deck of the type discussed above is described in U.S. Pat. No. 4,141,821. In this apparatus, the substantially square sieve elements are not only secured to the support structure at each of their four corners, but they also rest with their long sides facing one another on parallel struts which make up the support structure. The sieve elements, with their rims, project over these struts of the support structure and are accordingly supported over the entire length of their long sides. The known realization is associated with the disadvantage that the sieve elements cannot have any sieve openings in the vicinity of their longitudinal rims resting on the support structure, which limits the actual open surface area available for sifting. Furthermore, the struts of the support structure must be adapted both in terms of the direction in which they extend and in their dimensions to the sides of the sieve elements which will rest upon them. The width of the support struts of the support structure must therefore not be below a certain given width, so that in the known embodiment the expense for materials used to make up the support structure cannot be reduced any further.

THE INVENTION

With a sieve deck of the type described above as a point of departure, the invention has the fundamental object of attaining a larger actually effective open surface area for sifting.

This object is attained, in a sieve deck of the general type described, as a result of the provision that the sieve elements are supported at a distance from the support structure only in the vicinity of the corners thereof which are secured, and that they are connected with the support structure itself via spacer elements.

The particular advantage of a sieve deck according to the invention is that the support of the sieve elements solely in the vicinity of their corners accordingly enables an enlargement of the actually effective open surface area for sifting, because the sieve openings are capable of extending as far as the rim of the individual sieve elements, or even beyond that. Because the support structure is shifted downward from the underside of the sieve elements and disposed at a distance therefrom, the passage through the sieve of the material to be sifted is not hindered even in the vicinity of those sieve openings which are located (viewed in the direction in which the material to be sifted will pass through the sieve) above the individual struts of the support structure. In order to prevent the effect of abrasion on the struts as a result of the sifted material, the struts of the support structure can be provided on their upper surface with a streamlined shape and/or a wear-prevention coating.

According to a further embodiment of a sieve deck according to the invention, the spacer elements may either be rigidly attached to the sieve elements or embodied as separate components which can be inserted between the sieve elements and the support structure. It is also possible to dispose the spacer elements rigidly on the support structure. In that case, the spacer elements may advantageously be embodied by sawhorse-type supports on the support structure.

The streamlined shape of the upper surface of the support structure struts can be provided by embodying the upper surface of these struts as either oblique or convexly curved surfaces. In particular, the upper surfaces of the support structure struts may have the form of a peaked roof.

A further advantageous embodiment of a sieve deck according to the invention is represented by the supporting of adjacent sieve elements each with their adjoining corners resting on a single spacer element. The spacer elements advantageously have a single reception opening on their upper surface for centrally securing all the adjacent corners of the respective sieve elements. The sieve elements are furthermore advantageously fixed in the reception openings of the spacer elements directly via stubs at the corners and/or via securing pins.

In a further advantageous embodiment, the sieve elements are made of an elastic solid material having reinforcement embedded in it either entirely or in part. It is furthermore advantageous for the sieve elements to have sealing lips extending around the circumference of lateral abutting faces.

BRIEF DESCRIPTION OF THE DRAWING FIGURES

The invention will be explained in further detail with the aid of exemplary embodiments as shown in the drawing.

THE BEST MEANS OF REALIZING THE INVENTION

Figure 1:
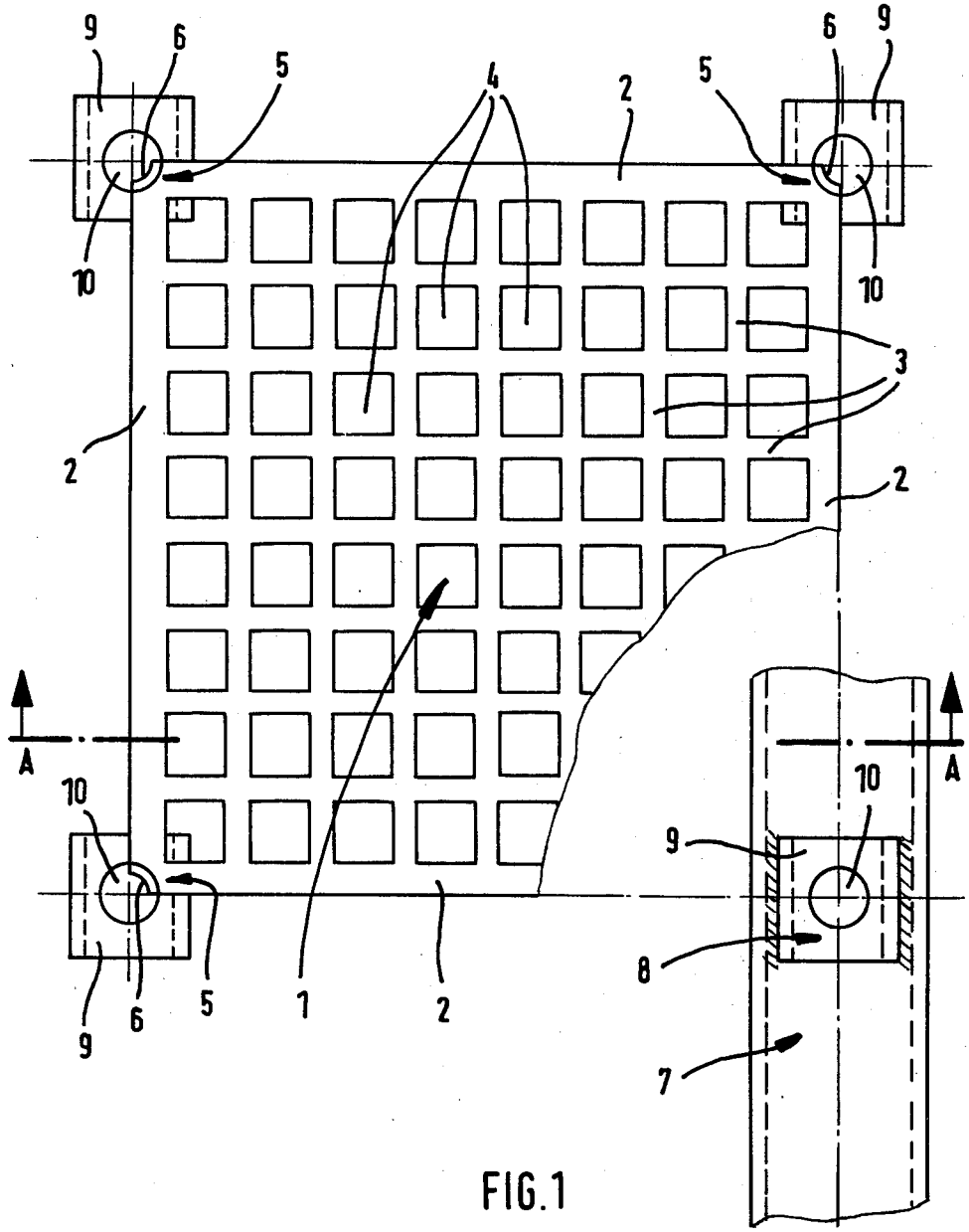
FIG. 1 is a plan view of a sieve element having spacer elements and with the support structure shown in part for a sieve deck according to the invention.
Figure 2:
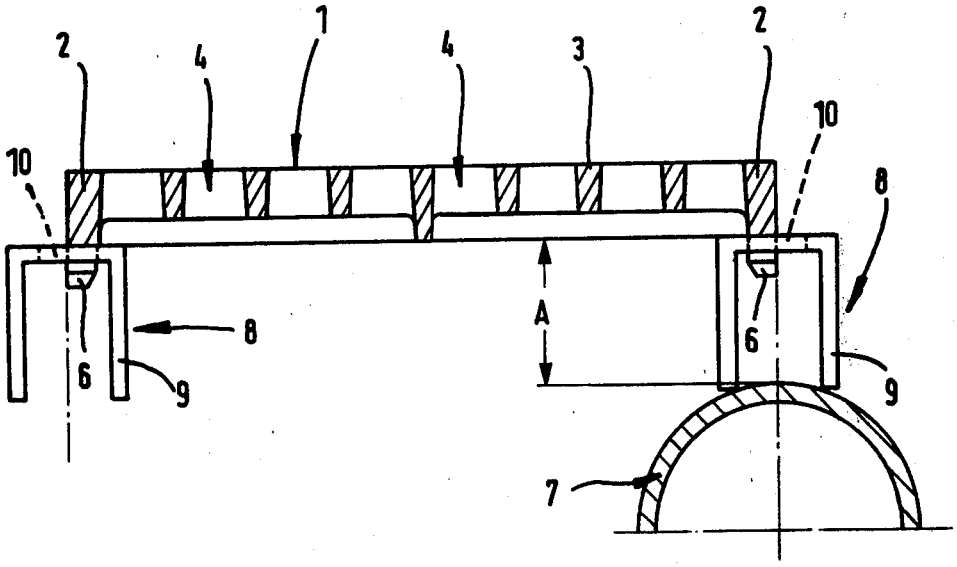
FIG. 2 is a section taken through the sieve element along the line A—A of FIG. 1.

FIGS. 1 and 2 show the fundamental design of a sieve deck according to the invention. It is substantially made up of sieve elements 1, which extend to form a continuous separation face. To this end, the individual sieve elements 1 abut one another at the same level and without space between them, which is sufficiently well known and is therefore not shown in further detail in the drawing.

Each individual sieve element has the fundamental shape of a regular polygon and in a preferred realization takes the form of a square, as is shown in the drawing. On this point, it is essential that the individual sieve elements be not only secured but also supported only in the vicinity of the corners of the respective polygon; that is, in the case where the basic shape is square, only in the vicinity of the four corners. If the sieve elements have a greater number of corners, then the support of the individual sieve elements can also be provided only at some of these corners. Thus it is possible to secure and support a hexagonal or octagonal sieve element only in the vicinity of every other corner.

The sieve elements 1 substantially comprise rim ribs 2 and intersecting inner ribs 3, which enclose sieve openings 4. In the exemplary embodiment shown, the sieve openings 4 have the same basic shape as the sieve element 1 itself. However, they may also have a shape different from that of the sieve element; in particular, they may take the shape of a slit or gap.

At their corners 5, the sieve elements 1 have stubs 6 at the underside, which protrude downward beyond the lower limiting face of the sieve elements 1. The sieve elements 1 are secured with these stubs 6 on their underside to a support structure 7 disposed therebelow, the connection of the sieve elements 1 with the support structure 7 being effected via spacer elements 8. These spacer elements 8 serve to provide a distance "A" between the underside of the sieve elements 1 and the upper side of the support structure 7. The sieve elements 1 may also be secured on the spacer elements 8 by some other means than by way of the stubs 6. In the exemplary embodiment shown in FIGS. 1 and 2, the support structure is made up of tubular support struts onto which sawhorse-type supports 9 are placed, acting as spacer elements 8, in the vicinity of the adjacent corners 5 of the sieve elements 1. These sawhorse-type supports 9 have one or more reception openings 10 on their upper side, into which the stubs 6 on the underside of the sieve elements 1 are inserted and are fixed therein. In a preferred realization such as that of the exemplary embodiment, all the stubs 6 in the vicinity of the adjoining corners of adjacent sieve elements 1 engage a single common reception opening 10 of the spacer elements 8. In an efficient manner, the stubs 6 of the sieve elements 1 have to this end the form of a quarter-cylinder or quarter-cylindrical tube, so that in the case where the basic shape of the sieve elements 1 is square, the four stubs 6 adjoining one another combine, at the adjoining corners 5 of the sieve elements 1, to form one complete cylinder or one complete cylindrical tube engaging the reception opening 10 of the associated sawhorse-type support 9. The fixation of the stubs 6 at the corners of the sieve element 1 in the reception openings 10 of the sawhorse-type supports 9 may be effected either by means of a pushbutton-type embodiment or by expansion pins which are to be inserted in addition.

As a result of the support of the sieve elements 1 on points on the support structure 1, it is not necessary to have the struts of the support structure 7 extend parallel to the rim ribs 2 of the sieve elements 1 as shown in FIG. 1. The struts of the support structure 7 could, for instance, instead be disposed diagonally with respect to the sieve elements 1.

Figure 3:
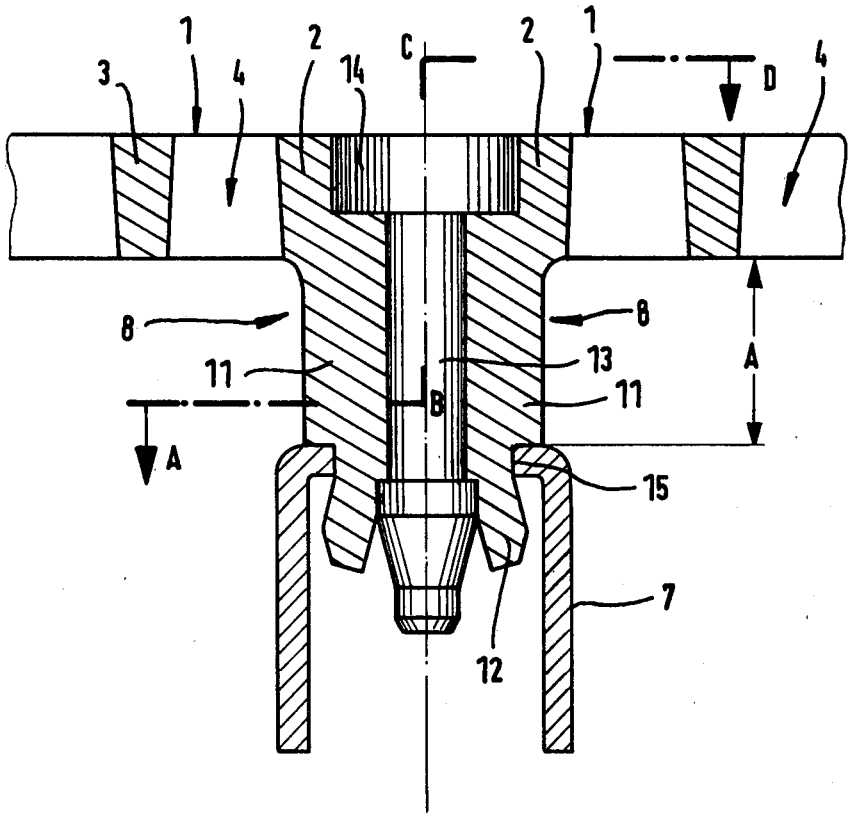
FIG. 3 is a section taken through the corner fastening of adjacent sieve elements of a sieve deck according to the invention having spacer elements formed on the sieve elements.
Figure 4:
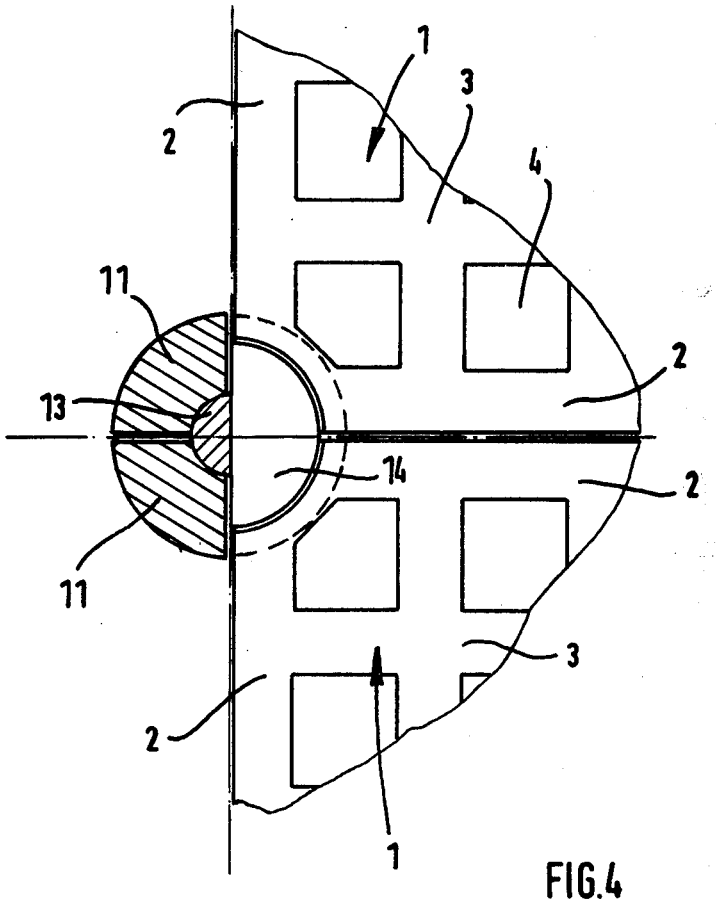
FIG. 4 is a section taken along the line A-B-C-D of FIG. 3.

FIGS. 3 and 4 show sieve elements 1 for a sieve deck according to the invention having the spacer elements 8 on the underside molded directly on the sieve elements 1 in the form of protruding spacer feet 11. The height of the spacer feet 11 determines the distance "A" between the underside of the sieve elements 1 and the upper side of the support structure 7 of the sieve deck. The spacer feet 11 are embodied as quarters of tubular sheaths and have spreading tabs 12 on their lower end with which they are passed through securing openings 15 on the upper side of the associated struts of the support structure 7. A securing pin 13 is inserted into the passageway formed by the extended spacer feet 11. This securing pin 13 spreads apart the spreading tabs 12 and thus holds the sieve elements 1 securely on the support structure 7. The sieve elements 1 are also held securely on the support structure 7 in the vertical direction by means of a well-defined head 14 of the securing pin 13, which has been sunk into the upper side of the sieve elements 1.

Figure 5:
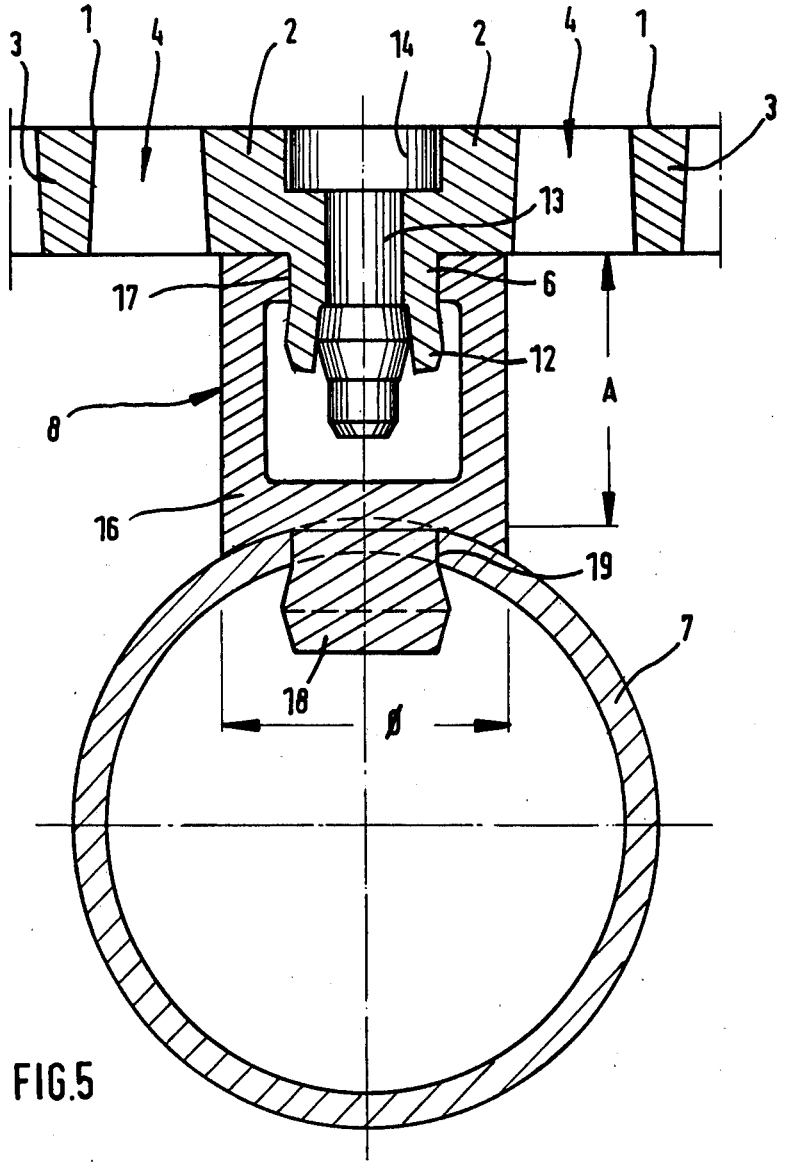
FIG. 5 is a section through a different corner fastening of adjacent sieve elements of a sieve deck according to the invention having separate spacer elements.

FIG. 5 shows a further realization of a sieve deck according to the invention, in which the sieve elements 1 are connected with the support structure 7 via spacer elements 8 embodied as separate components 16. The securing of the sieve elements 1, via the downwardly protruding stubs 6 at the corners, on the spacer components 16 may be effected in the same manner as the securing of the sieve elements 1 as shown in FIG. 3 with rigidly molded spacer elements 8 attached to the sieve element 1. To this end, the stubs themselves, with their free ends, constitute the spreading tabs 12 and receive the securing pin 13 in the passageway formed by extension. The separate spacer components 16 have a corresponding reception opening 17 at the top, through which the stubs 6 of the sieve elements 1 are passed.

The securing of the spacer components 16 on the support structure 7 located below them may be effected via detent heads 18 molded onto the lower side which are inserted into corresponding fastening openings 19 of the support structure 7 in the manner of buttons in buttonholes. The spacer components 16 are efficiently made of an elastic material, such as plastic in particular, this being preferably the same material as that used to make the sieve elements 1. The securing pins 13 may be made of the same plastic material.

In the embodiment of FIG. 5, as well, the height of the spacer components 16 determines the essential distance "A" between the underside of the sieve elements 1 and the upper side of the support structure 7.

Figure 6:
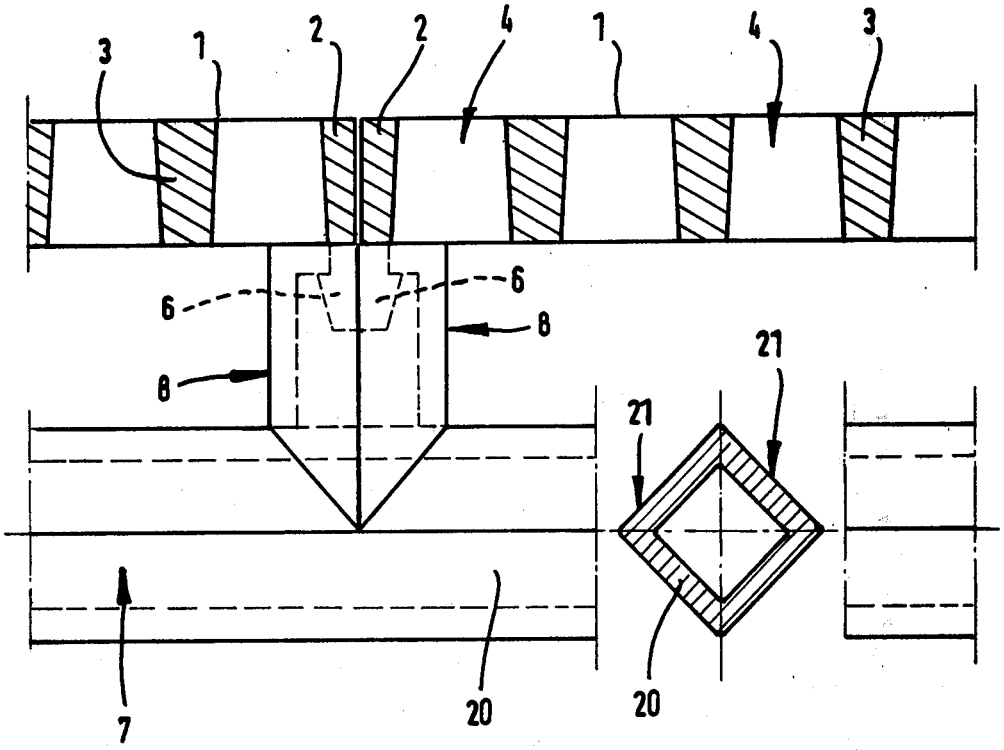
FIG. 6 is a section taken through a further embodiment of a corner fastening of the sieve elements of a sieve deck according to the invention having spacer elements attached to the support structure.
Figure 7A:
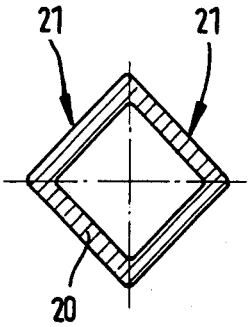
FIG. 7 shows cross-sectional shapes of the struts of the support structure of a sieve deck according to the invention.
Figure 7B:
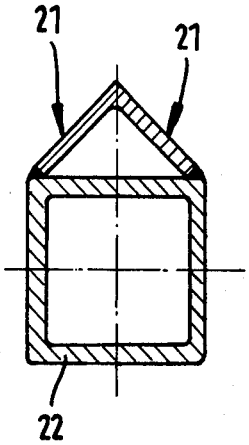
Figure 7C:
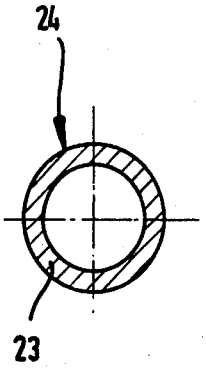
Figure 7D:
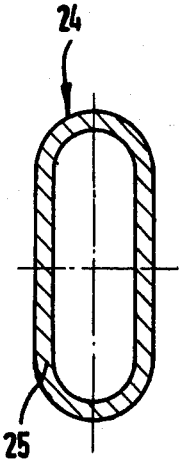

Just as do FIGS. 1 and 2, FIG. 6 shows one realization of a sieve deck according to the invention, in which the spacer elements 8 are firmly attached to the framework of the support structure 7. The special feature of the support structure 7 used here is that its struts 20 are embodied by a vertically disposed square profile section. This makes it possible to make the upper sides 21 of the struts 20 of the support structure 7 oblique, taking the form of a peaked roof, so as to make it easier for the sifted material to slide away from the struts 20. As a result, first the abrasive stress exerted by the sifted material on the support structure is reduced to a minimum, and second the sifted material is prevented from leaving a residue on the upper side of the support structure 7.

Other possible cross-sectional shapes for the struts of the support structure 7 with which these advantages are attained are shown in FIG. 7. FIG. *7a* shows once again the square cross-sectional profile for the struts 20 having upper sides 21 made oblique in the manner of a peaked roof. FIG. *7b* likewise shows a strut 22 having upper sides 21 made oblique in the manner of a peaked roof. However, this is attained in this case by the placement of an L-bar at the top of a square profile section which is laid flat. FIG. *7c* shows a strut 23 which has the cross-sectional profile of a cylindrical tube having a curved upper side 24. In like fashion, the strut 25 shown in FIG. *7d* also has a curved upper side 24, in this case because the cross section is that of a flat oval, with the longer axis of the oval being located in the vertical direction. What is of the essence in all the cross-sectional forms shown and all other possible forms of the support structure struts is that the upper sides as formed are disposed as inclined toward the separating face embodied by the sieve elements lying one above the other.

Figure 8:
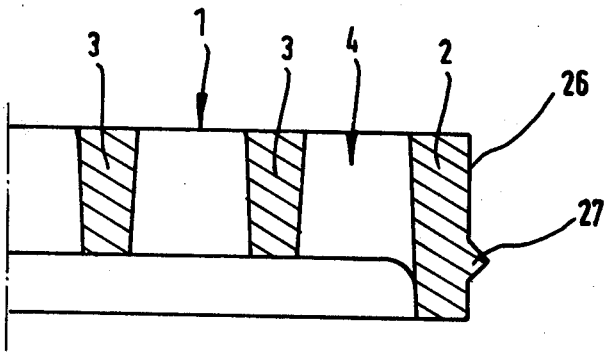
FIG. 8 is a partial section taken through the rim of a sieve element for a sieve deck according to the invention.

Since the sieve elements 1 in a sieve deck according to the invention are supported on points, solely at their corners, there is the danger that open gaps can form between the lateral abutting faces 26 of the adjacently located sieve elements and toward the bottom, through which the sifted material can escape. In order to prevent this, the sieve elements 1 may have at least one sealing lip 27 extending all the way around their lateral abutting faces 26, as is shown in FIG. 8.

Figure 9:
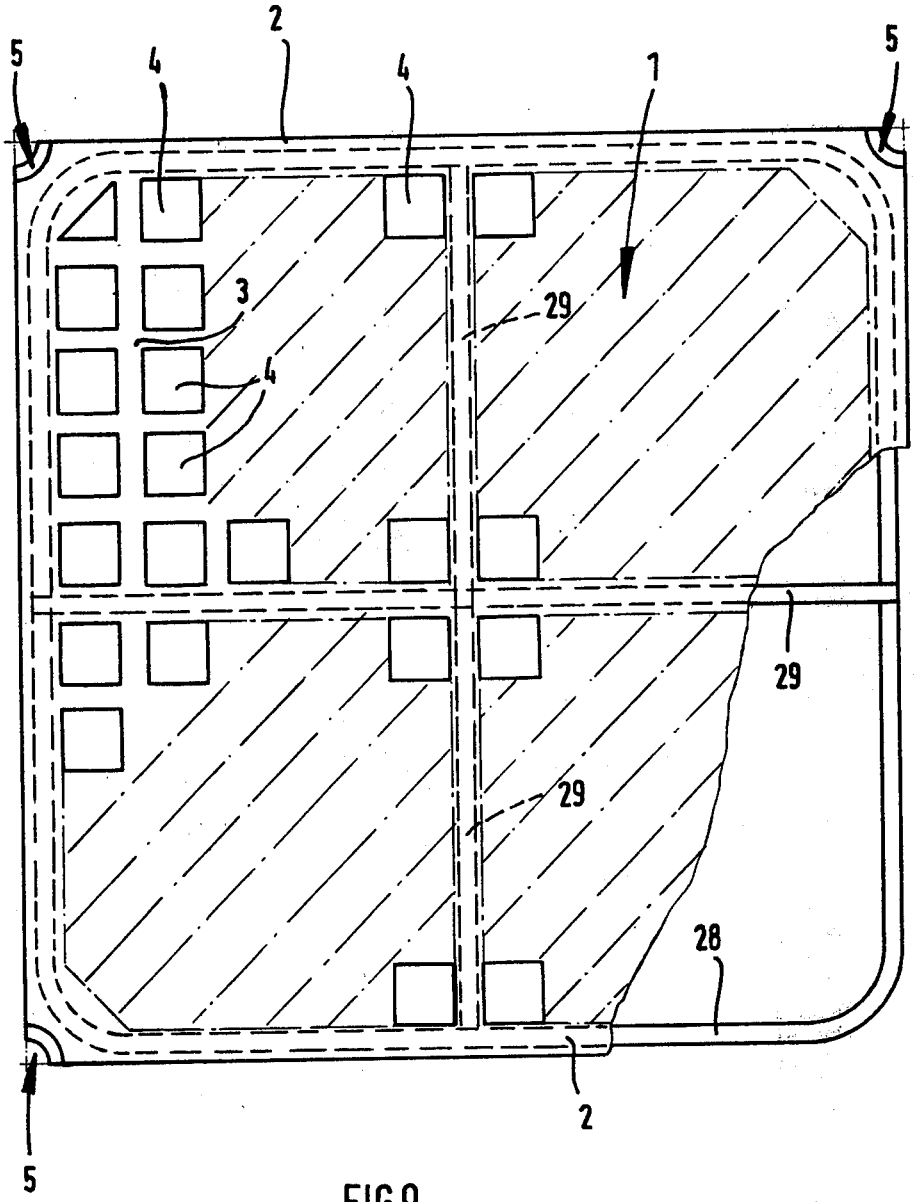
FIG. 9 is the plan view of a further sieve element for a sieve deck according to the invention having embedded reinforcement.

FIG. 9 shows a sieve element such as that preferably used for a sieve deck of the type according to the invention. It is made of an elastic solid material which has been reinforced by an embedded reinforcement 28, 29. The reinforcement is made up first of an annular reinforcement 28 around the outside, which is located in the vicinity of the rim ribs 2 and extends substantially between the support corners 5 of the sieve elements 1. An embedded cruciform reinforcement 29 is disposed in the direction of the crosswise and lengthwise center of the sieve element 1. Both the outer reinforcement 28 and the inner, cruciform reinforcement 29 may be embedded either entirely or in part in the elastic solid material of which the sieve elements 1 are made.

Figure 10:
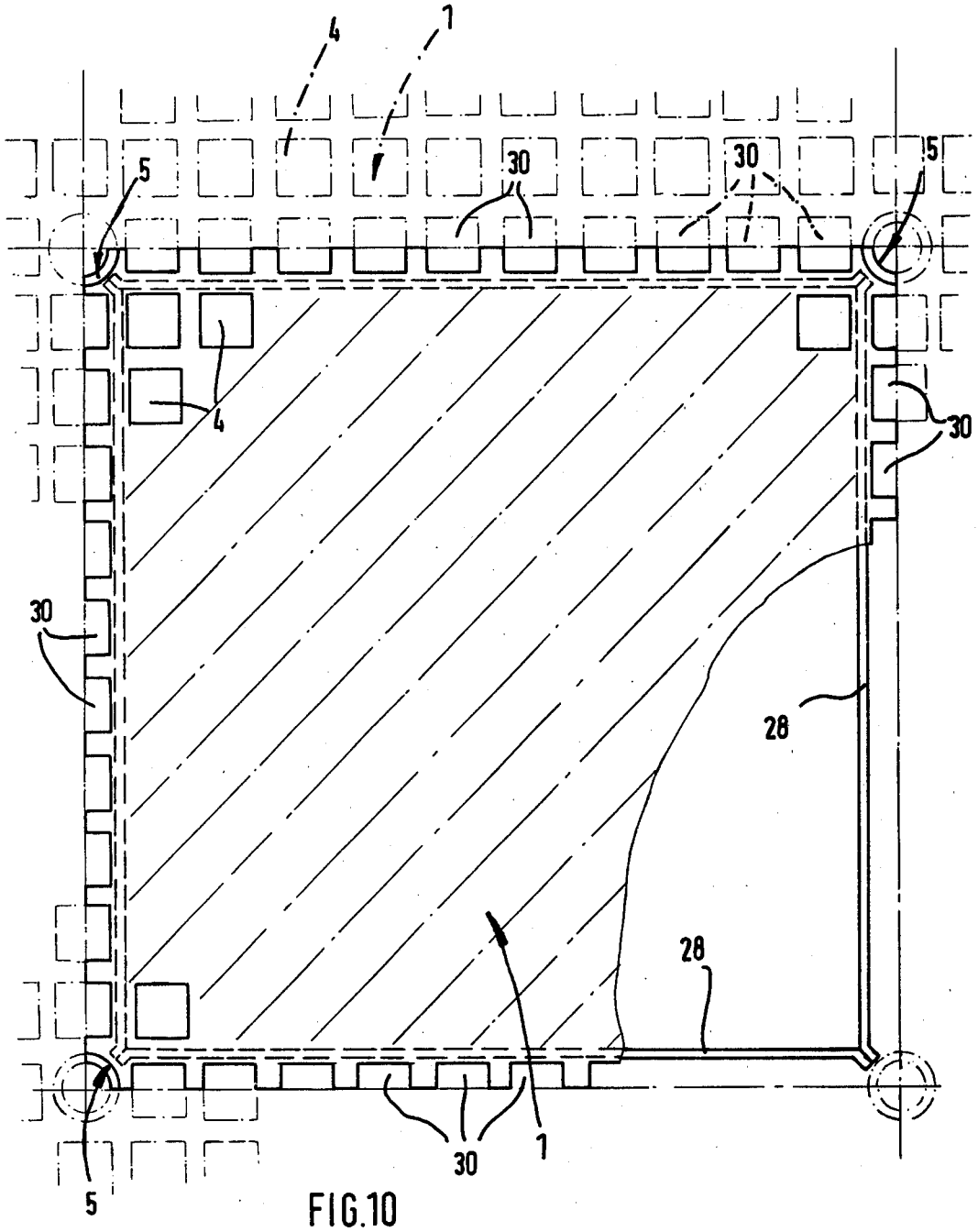
FIG. 10 is the plan view of a different sieve element for a sieve deck according to the invention having embedded reinforcement.

FIG. 10 shows a further realization of the sieve elements for a sieve deck according to the invention. Here, as well, the sieve elements 1 are made of elastic solid material having an outer, annular reinforcement 28 which extends between the support corners 5 of the sieve elements 1. However, in this case the reinforcement 28 is shifted somewhat toward the inside, so that recesses are formed along the rims of the sieve elements 1 resulting in halves of outwardly-opening sieve openings 30. These halves of sieve openings 30 then, together with the half-openings 30 at the rims of adjoining sieve elements 1, combine to make one whole sieve opening, as shown in FIG. 10. As a result, a sieve surface is attained which has a uniform grid extending over all the sieve elements 1. The same effect is also attained if the rim ribs 2 of the sieve elements 1 are embodied as being half the width of the inner ribs 3.

I claim:

1. A sieve deck for sifting machines, sifting boxes or the like, comprising a support structure and sieve elements releasably disposed thereon and provided with a multiplicity of sieve openings which extend to form a continuous separation face and have the fundamental shape of a polygon, wherein the sieve elements are secured on the support structure at least in the vicinity of their secured corners and are connected with this support structure via spacer elements, whereby the adjoining corners of adjacent sieve elements are supported on one single spacer element, which has a single reception opening on its upper side for centrally securing all the adjacent corners of the respective sieve elements.

2. The apparatus set forth in claim 1 wherein the support structure comprises elongated members having a sieve confronting surface inclined away from the sieve.

3. The apparatus of claim 1 wherein each sieve element has an a reinforced peripheral boundary.

4. The apparatus set forth in claim 1 wherein each sieve element has a sealing lip around the peripheral boundary thereof for abutment with the sealing lips of other sieve elements.

5. The apparatus set forth in claim 1 wherein the peripheral boundaries of the sieve elements respectively include openings therein which match openings in abutting elements to form a continuous plane of sieve openings.

* * * * *